United States Patent [19]

Fletcher

[11] 4,389,960

[45] Jun. 28, 1983

[54] BARGE

[75] Inventor: Edwin H. Fletcher, Marathon, Fla.

[73] Assignee: Transway International Corporation, New York, N.Y.

[21] Appl. No.: 887,664

[22] Filed: Mar. 17, 1978

[51] Int. Cl.[3] ..... B63B 21/56
[52] U.S. Cl. ..... 114/248
[58] Field of Search ..... 114/39, 77 R, 242, 248, 114/249

[56] References Cited

U.S. PATENT DOCUMENTS 815,737 3/1906 Pool ..... 114/39
1,406,602 2/1922 Baer ..... 114/249

*Primary Examiner*—Sherman D. Basinger
*Assistant Examiner*—Jesús D. Sotelo

[57] ABSTRACT

A barge with an open bottom well at the stern for receiving a tug for propelling the barge further includes a flexible seal which extends rearwardly into the open bottom of the well to engage the bottom portion of a tug propelling the barge to close the bottom of the tug recess well and reduce or eliminate hydrodynamic water resistance within the well.

4 Claims, 6 Drawing Figures

FIG. 1
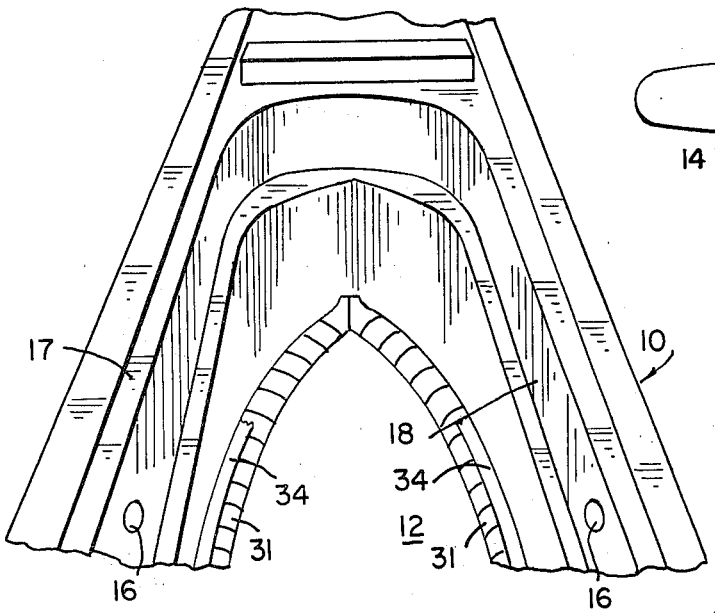
FIG. 2
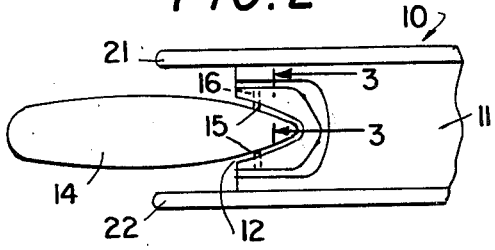
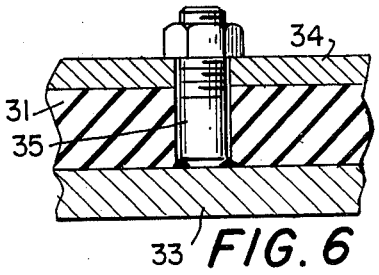
FIG. 6
FIG. 4
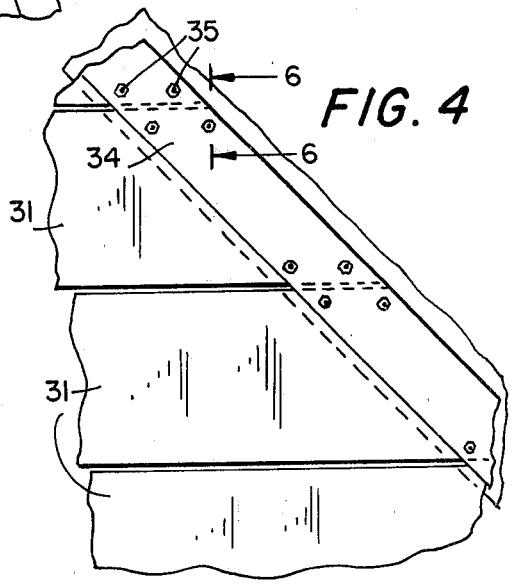
FIG. 3
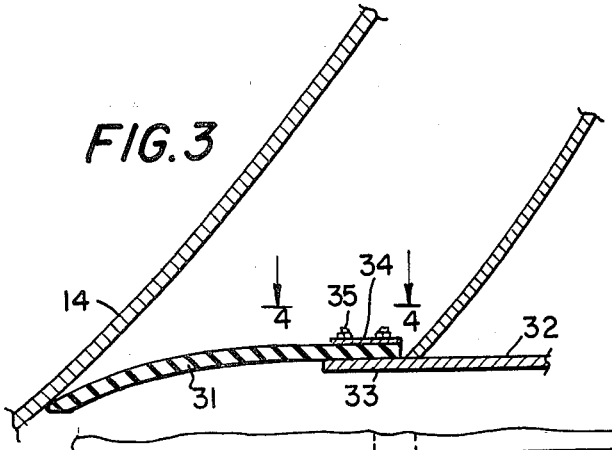
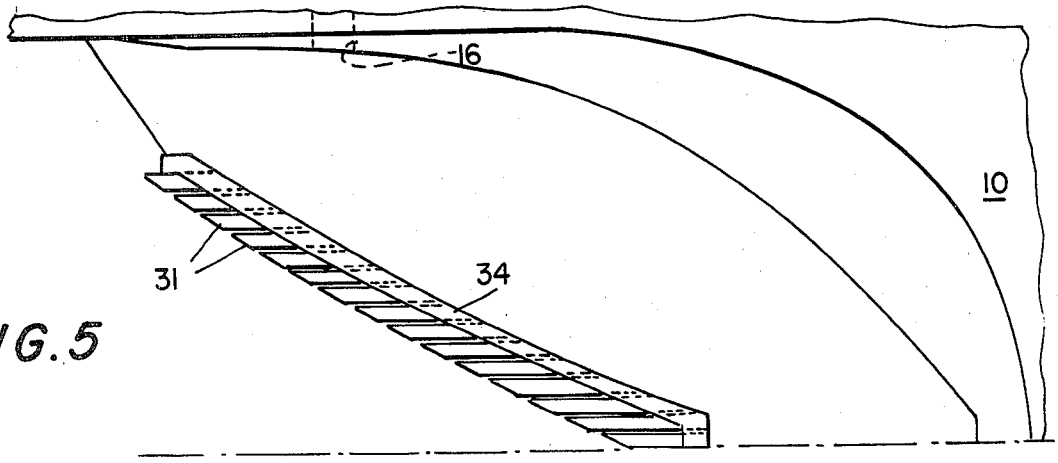
FIG. 5

BARGE

This invention relates to a barge, and more particularly, to an improved barge which is adapted to be pushed by a tug.

In U.S. Pat. No. 3,512,495, there is described an improved barge and tug which includes an articulated pin connection for pivotally connecting the tug to the barge, with the pin providing a positive force transmitting connection whereby the tug can propel and stop the barge.

The present invention is directed to an improvement in barges which are to be propelled through a positive force transmitting connection with an independent powered craft, such as a tug, and most particularly to a barge which is to be propelled by a tug through a force transmitting connection as described in U.S. Pat. No. 3,512,495.

In accordance with the present invention, there is provided a barge, including a barge bottom and a deck mounted thereon, with the stern of the barge including an open bottomed well for receiving a craft, such as a tug, for pushing the barge. The hull includes flexible sealing means which extends rearwardly into the open bottom well over a substantial portion of the perimeter thereof to sealingly engage the bow portion of the craft within the well and defining with the craft a closure for the open bottom of the well.

The invention will be further described with respect to a preferred embodiment thereof illustrated in the accompanying drawings wherein:

FIG. 1 is an isometric view of an embodiment of the barge of the present invention;

FIG. 2 is a simplified schematic representation of the barge embodiment of FIG. 1 being propelled by a craft;

FIG. 3 is a sectional view taken along line 3—3 of FIG. 2;

FIG. 4 is a sectional view taken along line 4—4 of FIG. 3;

FIG. 5 is a top view of the embodiment of FIG. 1; and

FIG. 6 is a detailed section taken along line 6—6 of FIG. 4.

It is to be understood, however, that the scope of the invention is not to be limited thereby.

Referring now to the drawings, there is illustrated in FIG. 2, a barge 10, including a deck 11 for carrying a cargo, with the stern of the barge including an open bottom well 12 for receiving the bow portion of a craft, for pushing the barge, such as tug 14. The tug 14 is connected to the barge 10 through a force transmitting articulated pin connection, of the type described in U.S. Pat. No. 3,512,495, which is hereby incorporated by reference, comprised of connecting pins 15 mounted on the tug 14 and pin receiving means 16 mounted in the opposed side walls 17 and 18 of the open bottom well 12 or barge 10. The force transmitting connection between the barge and tug is described in detail in the aforesaid U.S. patent and no further details in this respect are deemed necessary for a complete understanding of the present invention.

The barge 10 is also particularly shown as including stern wings 21 and 22; however, such stern wings can be omitted.

In accordance with the present invention, the bottom of the open bottom well 12 of barge 10 is provided with a sealing means which is designed to sealingly engage the bow portion of a tug pushing the barge to define with the tug a closure for the bottom of the well when the tug is propelling the barge. In this manner, water is prevented from moving within the open space between the tug and barge, during propulsion of the barge, thereby eliminating the resistance to propulsion which would normally be caused by such water movement within the open space.

As particularly shown, the bottom of the well portion 12 of barge 10 is provided with a flexible sealing means, in the form of a plurality of flexible resilient flaps 31, formed of a suitable flexible material, such as rubber, which are positioned in close alignment with each other over a substantial portion of the perimeter of the bottom of the open well 12, and below the water line of the barge. The barge bottom 32, in the open well portion, is provided with a lip portion 33 and the flaps 31 are fixedly mounted between a metal bar 34 and the lip portion 33 by a suitable fastening means, such as bolts 35. The flaps 31 are specifically designed such that when the barge is propelled in the forward direction the flaps move upwardly in a slightly overlapping relationship with each other such that the flaps essentially form a continuous seal around the bottom perimeter of well 12.

The flaps 31 are normally angularly downwardly disposed in order to facilitate entry of a craft into the open well portion of barge 10; however, as a result of the flexibility thereof, when the barge is propelled in the forward direction the movement forces the flaps upwardly into sealing engagement with the bow portion of the tug 14, as shown in FIG. 3, to define with the tug a closure for the bottom of well 12 and substantially reduce or eliminate water resistance in the open well portion during movement of the barge.

The resilient flexible sealing means is capable of conforming to the shape of a wide variety of hulls of propelling crafts and remains in sealing engagement with the bow of the propelling craft even in rough weather irrespective of the relative motion between propelling craft and barge. It has been found that the use of the resilient sealing means significantly reduces fuel consumption.

Although the invention has been particularly described with respect to the preferred embodiment, it is to be understood that numerous modifications and variations thereof are possible within the scope of the present invention. Thus, for example, the seal means could be configured in a manner other than as particularly described. Thus, for example, the seal means could be in the form of one or more continuous strips, instead of flaps as particularly described.

Similarly, the barge can be propelled through a force transmitting connection other than the preferred force transmitting connection as described with reference to U.S. Pat. No. 3,512,495.

These and other modifications should be apparent to those skilled in the art from the teachings herein.

Numerous modifications and variations of the present invention are possible in light of the above teachings and, therefore, within the scope of the appended claims, the invention may be practised otherwise than as particularly described.

What is claimed is:

1. A barge comprising:

a barge bottom and a deck mounted on the barge bottom, said barge bottom and deck at the stern of the barge, including a well open at its bottom and rear for receiving the bow of a craft for pushing the barge; and a flexible sealing means having one end connected to the barge bottom below the water line and the other end free for movement into sealing engagement with a craft for propelling the barge, said flexible sealing means being positioned around the perimeter of the well and extending over a substantial portion thereof, said flexible sealing means extending rearwardly into the well a distance whereby the well bottom is open in the absence of a craft and whereby said flexible sealing means is maintained in sealing engagement with the bow portion of a craft received in the well during propulsion of the barge by the craft to define with the craft a closure for the bottom of the well to thereby reduce water resistance during propulsion.

2. The barge of claim 1 wherein the sealing means is comprised of a plurality of resilient rubber flaps.

3. The barge of claim 1 wherein side walls of the open bottom well include means for receiving a force transmitting articulated pin connection from a craft received in the open well.

4. The barge of claim 2 wherein the resilient rubber flaps are angularly downwardly disposed to facilitate entry of a craft into the well, propulsion of the barge forcing the flaps upwardly into sealing engagement with the bow portion of the propelling craft in the well.

* * * * *

UNITED STATES PATENT AND TRADEMARK OFFICE

CERTIFICATE OF CORRECTION

PATENT NO. : 4,389,960

DATED : June 28, 1983

INVENTOR(S) : Edwin H. Fletcher

It is certified that error appears in the above-identified patent and that said Letters Patent is hereby corrected as shown below:

Page 1, Left Column - Delete: "Assignee: Transway International Corporation, New York, N.Y."

Signed and Sealed this

*Eighteenth* Day of *September 1984*

[SEAL]

*Attest:*

GERALD J. MOSSINGHOFF

*Attesting Officer*

*Commissioner of Patents and Trademarks*